United States Patent [19]

Schweizer

[11] 4,179,539

[45] Dec. 18, 1979

[54] SKI SLOPE

[76] Inventor: Herbert Schweizer, Kirchstrasse 47, D 7024 Filderstadt, IV, Fed. Rep. of Germany

[21] Appl. No.: 934,117

[22] Filed: Aug. 16, 1978

[30] Foreign Application Priority Data

Aug. 18, 1977 [DE] Fed. Rep. of Germany ..... 2737222

[51] Int. Cl.[2] ..... A63G 21/00; B44F 7/00

[52] U.S. Cl. ..... 428/58; 428/15; 428/44; 428/92; 272/56.5 SS

[58] Field of Search ..... 428/15, 58, 17, 44, 428/45, 87, 89, 92; 272/56.5 SS

[56] References Cited

U.S. PATENT DOCUMENTS

| | | | |
|---|---|---|---|
| 2,924,455 | 2/1960 | Brunel | 428/15 X |
| 3,233,893 | 2/1966 | Meyer | 428/15 X |
| 3,350,092 | 10/1967 | Maki | 428/15 X |
| 3,422,732 | 1/1969 | York | 272/56.5 SS |
| 3,555,078 | 5/1951 | Gaylor | 272/56.5 SS |
| 3,574,107 | 4/1971 | Hurka | 428/15 |
| 3,821,064 | 6/1974 | Cima | 428/15 X |

FOREIGN PATENT DOCUMENTS

| | | | |
|---|---|---|---|
| 1418458 | 12/1975 | United Kingdom | 272/56.5 SS |

*Primary Examiner*—George F. Lesmes
*Assistant Examiner*—Daniel R. Zirker
*Attorney, Agent, or Firm*—Edwin E. Greigg

[57] ABSTRACT

An artificial skiing surface comprising a plurality of single elements formed from plastic adapted to be detachably joined together in side-by-side relationship including a base layer provided with a plurality of flexible upwardly extending plastic fingers and a plurality of sockets in each of which rotatable balls are disposed formed from plastic having a hardness greater than that of the fingers and having the same height as that of the fingers together with a guidance comb inserted in a groove in the base layer and having flexible teeth with globular tips which extend upwardly preferably to a height above that of the fingers to provide control of a ski sliding thereon.

6 Claims, 5 Drawing Figures

SKI SLOPE

BACKGROUND OF THE INVENTION

Various attempts have already been made to produce a skiing surface for use during the snow-free months, particularly such a surface made of plastic, the properties of which permit the use of winter skiing techniques without difficulty and which do not require retraining of the skier for a different skiing technique.

A skiing surface, such as one made of fiber bundles, as German Pat. No. 1,047,088 discloses, has the disadvantage in that in addition to rapid wearing down of the fibers due to high friction between the skis and the fibers, positive control of the skis is not possible.

The use of an elastic bottom layer of rubber with a top layer secured thereon according to the German laid-open patent application No. 2,041,046 has also proved to be unsuitable, since here, as well, besides other disadvantages, positive control of the skis is not possible. The same is true of the subject of the laid-open German patent application No. 22 55 641. A brush layer according to the laid-open German patent application No. 1,578,758, which has rows of bristles affixed uniformly onto a foundation layer, also does not produce the desired properties for smooth skiing. Glide needles as in laid-open German patent application No. 2,437,267 disclose no possibility of means for ski control such as is required in downhill skiing. Many glide surfaces of this type are subject to excessive heat as a result of friction and therefore to an unacceptable amount of wear.

OBJECT AND SUMMARY OF THE INVENTION

The invention has the object of providing a skiing surface which avoids the disadvantages which have been discussed above and which employs means that provide ski control similar to that provided by a snow slope.

The above is accomplished according to the ivention by the provision of a plurality of single elements each of which consists of a base layer, the upper surface of which is equipped with both a plurality of upstanding glide fingers and with sockets which have glide balls rotatably positioned therein together with at least one guidance comb disposed in a suitably provided groove.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 2:
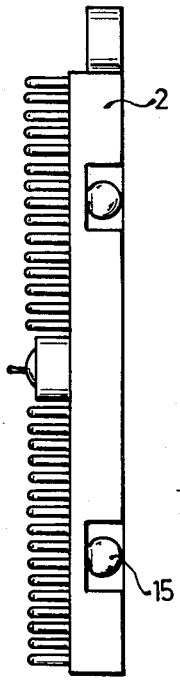
FIG. 2 is a side view of the single element of FIG. 1.
Figure 1:
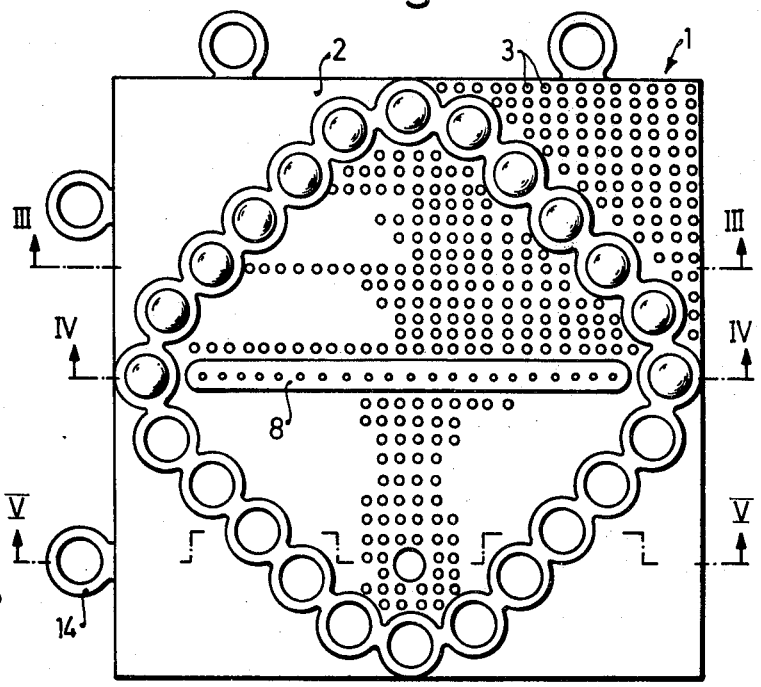
FIG. 1 is a plan view of a single element constructed in accordance with the invention.
Figure 3:
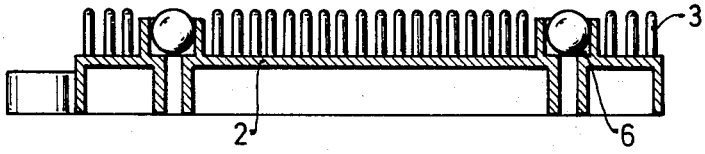
FIG. 3 is a sectional view taken substantially along line III—III of FIG. 1 in the direction of the arrows.

Referring now to FIG. 1, there is shown a single element 1, a plurality of which, as will be explained hereinafter, are utilized to form the artificial ski surface of the invention. The element 1 consists of a base layer 2, on the upper surface of which glide fingers 3 are provided which project upwardly to substantially the same height. Preferably, the glide fingers 3 are formed integrally with the base layer 2. However, if desired, they could also be inserted into the base layer by any suitable means, particularly if the base layer is of a different material from that of the glide fingers 3. The element 1 also includes glide balls 5 disposed for free rotation in sockets 4 formed in the base layer 2. As shown best in FIG. 3, the sockets 4 project upwardly from the upper surface of the base layer 2 and are preferably formed integrally therewith. As shown in FIG. 3, the glide balls 5 are inserted into the open end of the sockets 4 from above to such a depth that, at the bottom, they are seated on the floor 6 of the sockets 4. The glide balls 5, in the seated position in the sockets 4 are sufficiently higher at the top than the sockets so that the top of the balls 5 have the same height as the glide fingers 3 thereby permitting the balls 5 to rotate easily when they are skied over.

These sockets 4 with the glide balls 5 are arranged in a diamond configuration on each single element 1 as shown best in FIG. 1. However, a different distribution of the glide balls 5 and of the sockets 4 may be selected which will accomplish the purpose. In one embodiment, the glide balls 5 are made of a very hard plastic.

Figure 4:
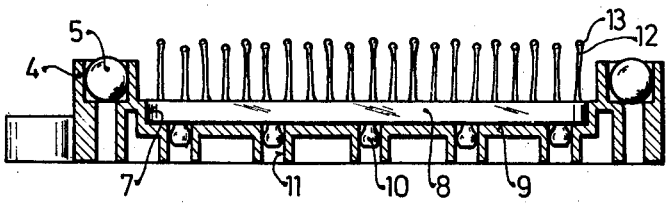
FIG. 4 is a sectional view taken substantially along line IV—IV of FIG. 1 in the direction of the arrows.
Figure 5:
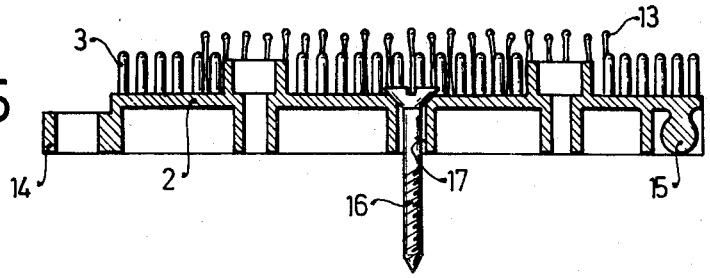
FIG. 5 is a sectional view taken substantially along line V—V of FIG. 1 in the direction of the arrows.

As shown best in FIGS. 1, 4, an elongated groove 7 is provided in the upper surface of the base layer 2 in which a guidance comb 8 is inserted. The guidance comb 8 has a spine 9 on which protuberances 10 are formed which project downwardly into bores 11 formed in the base layer 2. The guidance comb 8 is also provided with teeth 12 which project upwardly to a height above the glide fingers 3 and the free ends of the teeth 12 are provided with a spherical thickening or globular tip 13. The teeth 12 are made of a soft, flexible plastic, so that when they are skied over, they bend easily and thus provide good control of the ski by the skier.

On two adjacent side edges of the base layer 2 of each of the elements 1 there are provided eyes 14 arranged in spaced relationship and on the other two adjacent side edges of each base layer 2 there are provided connector stubs 15 also arranged in a correspondingly spaced relationship. The eyes 14 and the stubs 15 fit into the corresponding connector eyes and stubs of the adjacent single elements 1 when the elements 1 are to be interconnected in side-by-side relationship to form a skiing surface.

To secure each of the single elements 1 on the surface of the ski slope, a helically threaded screw 16 is provided which is inserted through a bore 17 in the base layer 2 and into threaded engagement with an underlying supporting surface.

The particular advantages of the upper surface of a ski slope formed using the elements 1 of the invention, (i.e., the invention—laid over a natural slope) is derived from the use of the hard glide balls 5 in the single elements 1, as abrasion and the attendant heat are largely reduced and therefore wear on the entire upper surface is also reduced.

Furthermore, the guidance comb 8 with its extremely soft teeth 12 provides good control of the skis by the skier. The teeth 12 can be of varying height and it is easily possible to vary the number of combs 8.

Both the guidance comb 8 and the glide balls 5, as well as entire single elements 1, are easily and quickly interchangeable, so that maintenance of the slope can be carried out quickly at any time.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A skiing surface comprising a plurality of single elements formed of plastic and adapted to be joined together in a side-by-side relationship, each single element including a base layer, a plurality of glide fingers on the upper surface of said base layer extending perpendicular to said base layer surface, a plurality of sockets in the upper surface of said base layer, a glide ball which extends upwardly from each socket to a height at which the top of the ball is coincident with the height of the glide fingers and is rotatably disposed in each of said sockets, at least one elongated groove in the upper surface of said base layer and a guidance comb which includes a plurality of easily flexible teeth, said teeth extending upwardly from the surface of said base layer to a height greater than the height of the glide fingers, each of the teeth being provided with a spherical thickening on its upper end, said guidance comb mounted in said groove.

2. A skiing surface according to claim 1, characterized in that said glide fingers and said glide balls are formed from plastic, the plastic of said glide balls having a hardness greater than the plastic of said glide fingers and wherein said glide balls are distrubuted in a selected pattern throughout the upper surface of said base layer to provide a reduction in the friction between the ski and said glide fingers during sliding movement of a ski on said glide fingers.

3. A skiing surface according to claim 2, characterized in that said teeth are of varying heights.

4. A skiing surface according to claim 3, characterized in that at least one connector eye is provided on each of a pair of adjacent edges on said base layer of each single element, and at least one connector stub on each of the other pair adjacent side edges of each single element, said eyes and stubs being correspondingly located for interengagement for interconnecting adjacent single elements.

5. A skiing surface according to claim 4, characterized in that each single element is provided with a bore extending vertically therethrough and a helically threaded screw arranged to be inserted through said bore for securing the single element to the surface of a ski slope.

6. A skiing surface according to claim 5, characterized in that each said single element, said glide balls and said guidance combs are easily interchangeable.

* * * * *